US005720640A

United States Patent [19]

Lu et al.

[11] Patent Number: 5,720,640

[45] Date of Patent: Feb. 24, 1998

[54] INVISIBLE SPACERS FOR FIELD EMISSION DISPLAYS

[75] Inventors: Jin-Yuh Lu, Taipei; David Nan-Chou Liu, Chutung; Jammy Chin-Ming Huang, Taipei, all of Taiwan

[73] Assignee: Industrial Technology Research Institute, Hsinchu, Taiwan

[21] Appl. No.: 602,095

[22] Filed: Feb. 15, 1996

[51] Int. Cl.[6] ..... H01J 9/26

[52] U.S. Cl. ..... 445/24; 313/495

[58] Field of Search ..... 445/24, 50; 313/309, 313/495

[56] References Cited

U.S. PATENT DOCUMENTS 5,509,840 4/1996 Huang et al. ..... 445/24

5,551,903 9/1996 Kumar et al. ..... 445/24

*Primary Examiner*—P. Austin Bradley

*Assistant Examiner*—Jeffrey T. Knapp

*Attorney, Agent, or Firm*—George O. Saile; Stephen B. Ackerman; Lappy J. Prescott

[57] ABSTRACT

This invention provides a method of fabrication and structure for spacers between the anode substrate and the cathode substrate of a field emission display. The spacers have a high aspect ratio and will be invisible to the human eye in the display image. An adhesive dielectric paste of glass frit in a binder is formed in cylindrical holes in a photoresist layer. Glass spacer spheres are placed on each column of dielectric paste. When fired the glass frit coalesces into a solid glass rod and bonds the glass spacer sphere to one end of the solid glass rod and the anode substrate to the other end of the solid glass rod. The firing also burns away the photoresist layer. The dark area in the image due to the spacers is less than 50 micrometers which will be invisible to the human eye.

10 Claims, 4 Drawing Sheets

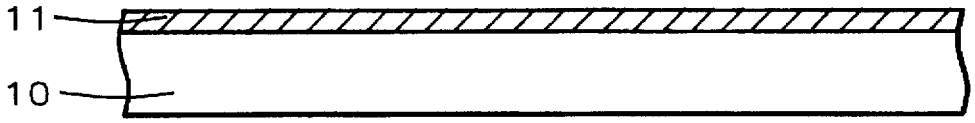
FIG. 1A – Prior Art
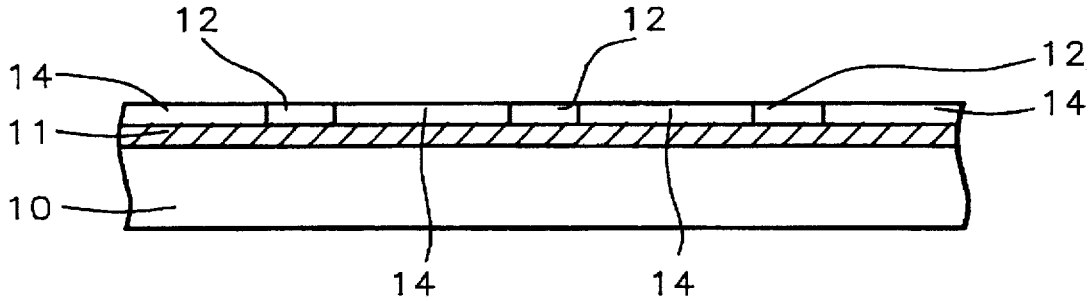
FIG. 1B – Prior Art
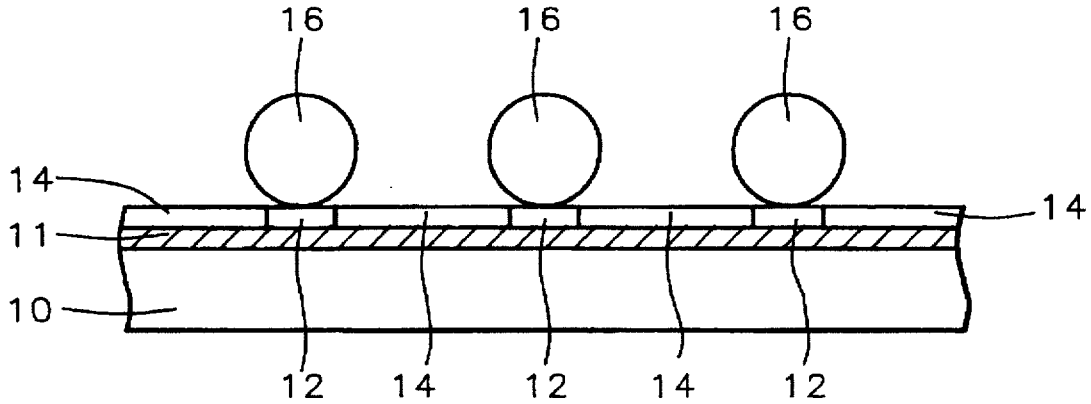
FIG. 1C – Prior Art

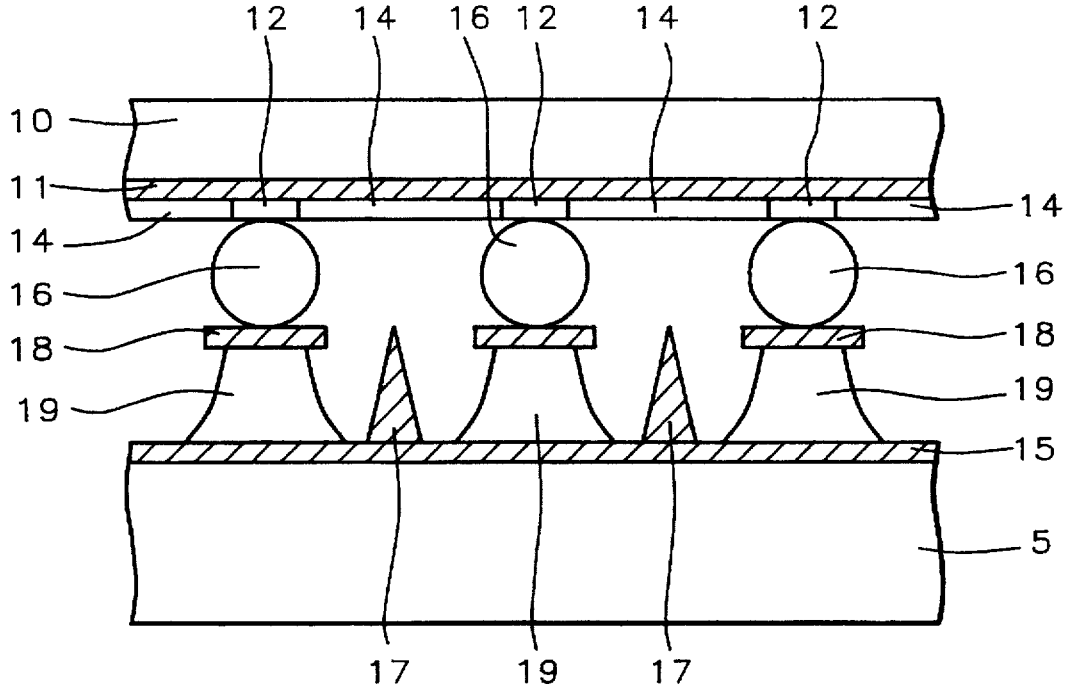
FIG. 1D – Prior Art
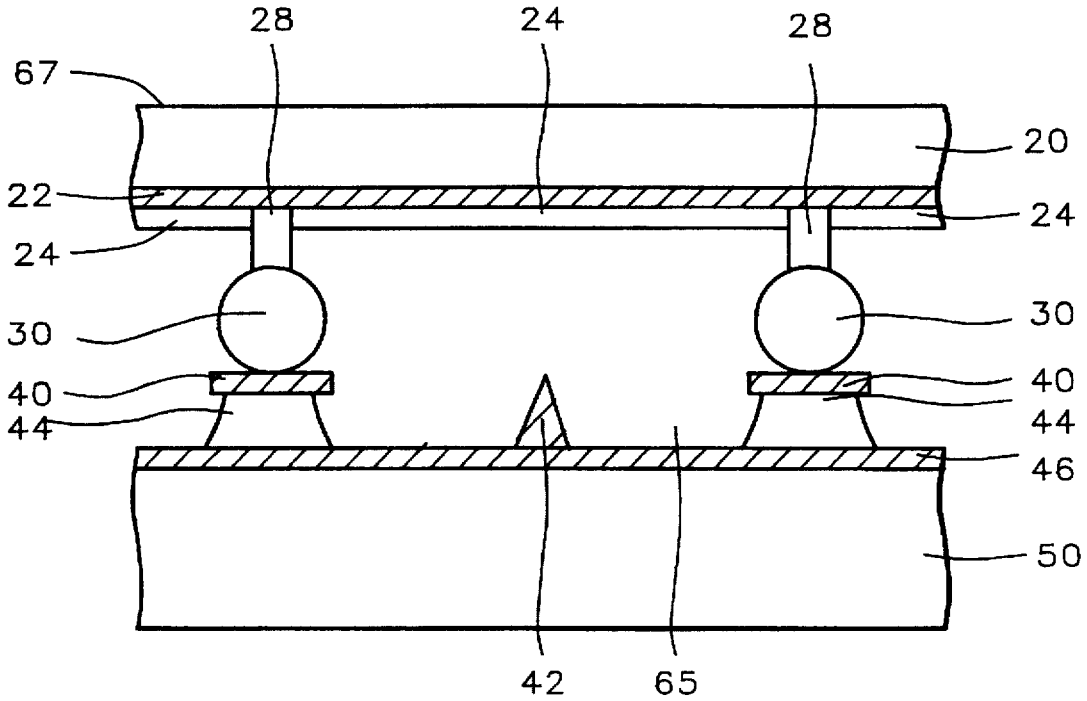
FIG. 7

INVISIBLE SPACERS FOR FIELD EMISSION DISPLAYS

BACKGROUND OF THE INVENTION

1. Field of the Invention

The invention deals with field emission flat panel displays and with methods of forming high aspect ratio spacers to separate the anode and cathode of these displays.

2. Description of the Related Art

In field emission displays a flat anode structure is placed parallel to a flat cathode structure with a small separation distance between them. A vacuum is maintained in the space between the anode structure and the cathode structure. A number of spacers are typically used to maintain a uniform distance between the flat anode and the flat cathode.

The image in the field emission display is formed when electrons are emitted from a number of emitters, formed as part of the cathode structure, and impinge on a phosphor layer formed as part of the anode structure thereby forming an image. One of the problems of these displays is that the spacers used to maintain the separation between the cathode structure and the anode structure cause dark areas in the image visible to the viewer of the display. These dark areas reduce the image quality of the display. Image quality and spacers has received the attention of a number of workers in the field of displays.

U.S. Pat. No. 5,328,728 to Swirbel et al. and U.S. Pat. No. 5,389,288 to Rindo et al. teach methods of forming ball type spacers to provide spacing between parallel plates of a Liquid Crystal Display.

U.S. Pat. No. 5,379,139 to Sato et al. shows the use of photoresist pillars as spacers for Liquid Crystal Displays but does not teach how the pillars are formed.

U.S. Pat. No. 5,338,240 to Kim teaches the use of elongated spacers for a Liquid Crystal Display. U.S. Pat. No. 4,975,104 to Kim teaches a method of forming barrier ribs to provide separation in a gas display panel.

U.S. Pat. No. 5,232,549 to Cathey et al. teaches forming spacers for flat panel displays by forming a layer of polymer material from which the spacers will be formed. A pattern of reflective material is formed on the polymer and the unwanted polymer material is removed with a laser. Alternately a laser is used to form holes in an etchable material. The holes are filled with spacer material and the etchable material is etched away.

U.S. Pat. No. 5,385,499 to Ogawa et al. teach a method of forming spacers by coating glass balls with glass frit of a low softening point. The assembly is heated and the glass frit is coalesced to form a sheath around the glass balls and a bond with wettable areas on the substrate. The excess glass balls are then removed and the remaining glass balls form spacers.

SUMMARY OF THE INVENTION

It is a principle objective of this invention to provide a method of forming high aspect ratio spacers for separating the anode structure and the cathode structure in field emission displays which will be invisible to the viewer of the field emission display.

It is a further objective of this invention to provide high aspect ratio spacers for separating the anode structure and the cathode structure in field emission displays which will be invisible to the viewer of the field emission display.

These objectives are achieved by forming spacers consisting of a solid glass rod with a glass sphere bonded to one end. The other end of the solid glass rod is bonded to the anode structure of the display. The glass sphere contacts the cathode structure of the display so that the solid glass rod and glass sphere form a high aspect ratio spacer for the anode and cathode of the display.

Refer now to FIGS. 1A–1D, there is shown a prior art method of forming spacers in field emission displays. As shown in FIG. 1A a transparent conductor layer 11 is formed on a transparent glass substrate 10. As shown in FIG. 1B a number of adhesive pads 12 formed of a material such as a glass paste having glass frit suspended in a binder material are formed on the transparent conductor layer 11. A phosphor layer 14 is formed on the transparent conductor layer in those regions not covered by the adhesive pads 12. Glass spacer spheres 16 are then placed on the adhesive pads, as shown in FIG. 1C. The assembly is then heated, the binder is driven off from the adhesive pads 12, and the glass spacer spheres are bonded to the adhesive pads 12 and the anode structure is formed as shown in FIG. 1C.

FIG. 1D shows the completed assembly of the prior art display. A cathode conductor layer 15 is formed on a cathode substrate 5. Emitters 17 are formed on the cathode conductor layer 15. Gate insulators 19 are formed on the cathode conductor layer and gate electrodes 18 are formed on the gate insulators 19. The transparent glass substrate 10 with the transparent conductor layer 11, the phosphor layer 14, the adhesive pads 12, and the glass spacer spheres 16 formed is then brought together with the cathode structure so that the glass spacer spheres 16 contact the gate electrodes 18 and provide separation between the anode structure and the cathode structure.

Electrons are emitted by the emitter 17 and impinge on the phosphor layer 14 thereby forming an image which is observed by the viewer. Because of the low aspect ratio of the spacers, ratio of spacer height to cross sectional area, the image will have dark areas caused by the spacers interferring with the path of the electrons. These dark areas will be visible to the viewer of the display and will reduce the quality of the image.

In this invention, as can be seen in FIG. 7, a solid glass rod 28 is formed between the glass spacer spheres 30 and the transparent conducting layer 22 formed on the glass substrate 20. The glass spheres 30 contact the gate electrodes 40 which are formed on the gate insulator layer 44. The emitters 42 are formed on the cathode conductor layer 46 which is formed on the cathode substrate 50. Electrons are emitted by the emitter 42 and impinge on the phosphor layer 24 thereby forming an image which is observed by the viewer. In this invention the solid glass rod 28 and the glass spacer spheres 30 form a spacer with a high aspect ratio and the dark areas in the image are eliminated from the image observed by the viewer.

BRIEF DESCRIPTION OF THE DRAWINGS

FIG. 1A shows a cross section view of a transparent anode substrate with a transparent conductor layer formed thereon for a prior art anode structure.

FIG. 1B shows a cross section view of a prior art anode structure with adhesive pads and a phosphor layer formed on the transparent anode substrate.

FIG. 1C shows a cross section view of a prior art anode structure with glass spacer spheres bonded to the adhesive pads.

FIG. 1D shows a cross section view of the completed prior art field emission display.

FIG. 7 shows a cross section view of the completed field emission display of this invention.

DESCRIPTION OF THE PREFERRED EMBODIMENTS

Figure 2:
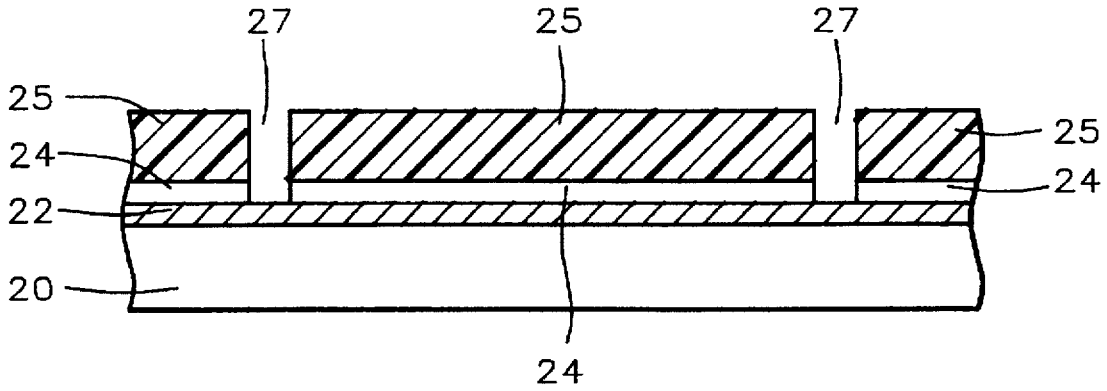
FIG. 2 shows a cross section of the transparent anode substrate of this invention with a transparent conductor layer, a phosphor layer, and a photoresist layer formed thereon.

Refer now to FIGS. 2–7, there is shown the preferred embodiment for forming the high aspect ratio spacers of this invention, which maintain the separation between the anode structure and cathode structure of a field emission display. FIG. 2 shows a cross section view of a transparent anode substrate 20 formed of a material such as glass and having a thickness of between about 0.55 and 3.0 millimeters. A transparent conductor layer 22 is formed on the transparent substrate 20. The transparent conductor layer is indium tin oxide, ITO, having a thickness of between about 20 nanometers and 300 nanometers. The transparent conductor layer 22 serves as the anode of the field emission display. A phosphor layer 24; having regions of red phosphor, green phosphor, and blue phosphor; is formed on the transparent conductor layer. The phosphor layer can be applied as a paste which is screen printed. Next a photoresist layer 25 having a thickness of between about 25 and 100 micrometers is formed on the phosphor layer 25. In this example the photoresist layer 25 is a dry film resist which is placed on the phosphor layer and laminated in place using a laminating temperature of between about 90° C. and 110° C. Cylindrical holes 27 are then formed in the layer of photoresist 25 and the phosphor layer 24 using photolithographic methods.

Figure 3:
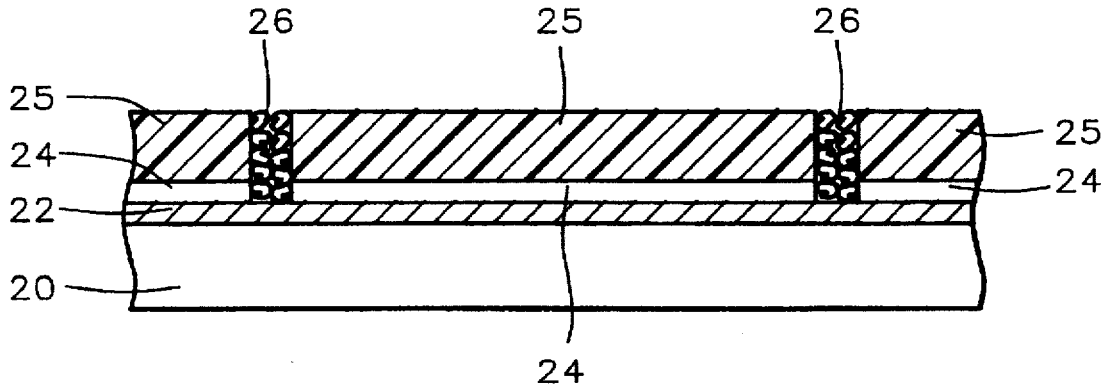
FIG. 3 shows a cross section view of the anode structure of this invention with a column of adhesive paste filling the holes formed in the phosphor layer and the layer of photoresist.
Figure 4:
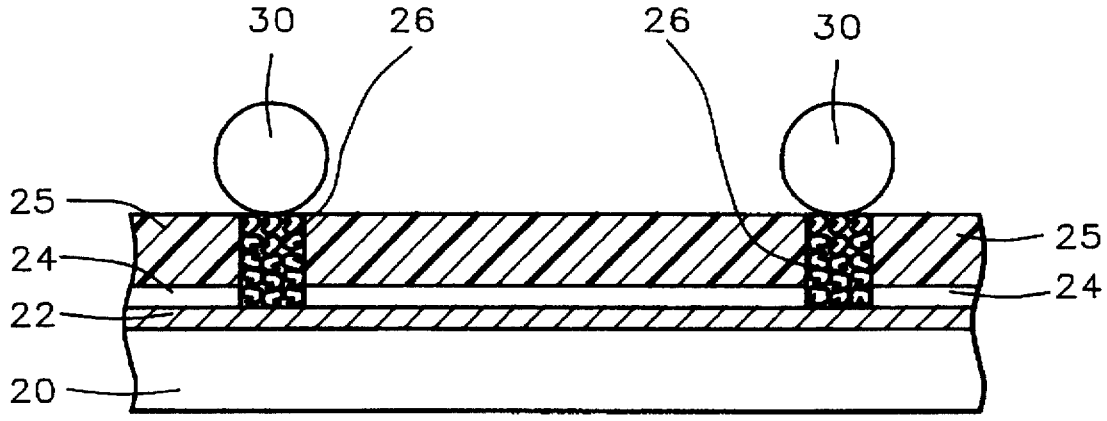
FIG. 4 shows a cross section view of the anode structure of this invention with spacer spheres placed on the column of adhesive paste filling the holes formed in the phosphor layer and the layer of photoresist.

As shown in FIG. 3, the holes in the layer of photoresist, photoresist holes, and the phosphor layer, phosphor holes, are then filled with a dielectric adhesive paste 26 forming a column of dielectric paste. The photoresist holes and the phosphor holes are filled with dielectric adhesive paste using methods such as screen printing or injection. The dielectric adhesive paste 26 is a glass paste comprising glass frit in a binder. Next, as shown in FIG. 4, spacer spheres 30 are placed on the dielectric adhesive paste 26 so that one spacer sphere 30 is on each column of dielectric adhesive paste 26. The spacer spheres 30 are glass spheres and can be placed by spraying a stream of glass spheres 30 on the layer of photoresist 25 having photoresist holes filled with dielectric adhesive paste. The dielectric adhesive paste will hold one of the glass spacer spheres 30 on the top of each column of dielectric adhesive paste 26 and the excess glass spacer spheres can be removed by methods such as a stream of air.

Figure 5:
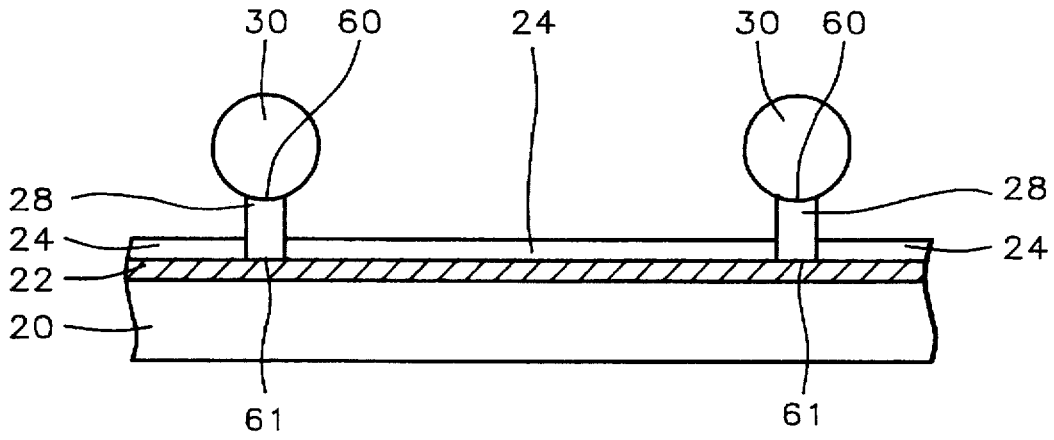
FIG. 5 shows a cross section view of the anode structure of this invention with the columns of adhesive paste coallesced into solid dielectric rods bonded to the spacer spheres and the transparent conductor layer.
Figure 6:
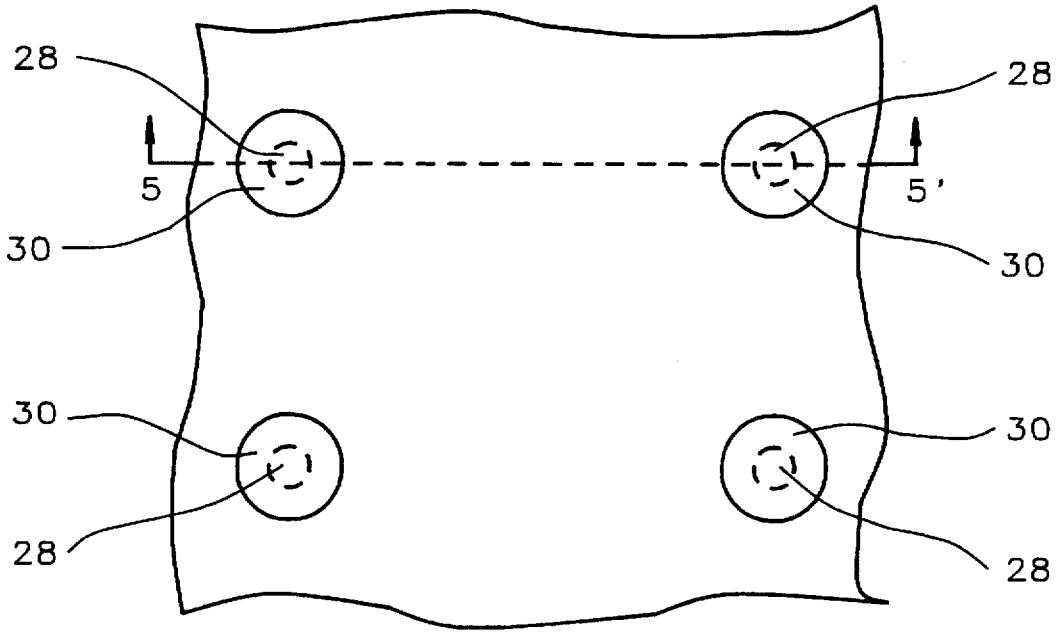
FIG. 6 shows the top view of the anode structure of FIG. 5.

Next the entire assembly is fired at, or heated to, a temperature of between about 450° C. and 520° C. for between about 10 and 45 minutes. During the firing the binder in the glass paste is driven off and the glass frit coalesces into a solid glass rod 28 having a cylindrical shape with a first circular end 60 and a second circular end 61. The first circular end 60 is bonded to the glass spacer sphere 30 and the second circular end 61 is bonded to the transparent conductor layer 22 during the firing. Also during the firing the photoresist layer is burned away. The photoresist layer can also be removed by dipping in potassium hydroxide, KOH, or firing in air. The anode structure is then complete as shown in FIG. 5. The top view of the completed anode structure is shown in FIG. 6.

A cross section of the embodiment of the field emission display is shown in FIG. 7. As shown in FIG. 7, the anode structure is brought together with the cathode assembly. The cathode assembly comprises a cathode substrate 50 with a cathode conductor layer 46 formed thereon. The cathode substrate 50 is formed of a material such as silicon. Emitters 42 are formed on the cathode conductor layer 46 and emit electrons when the appropriate electrical signals are applied to the emitters 42 by the cathode conductor layer 46. Gate insulators 44 are formed on the cathode conductor layer 46 and gate electrodes 40 are formed on the gate insulators 44. The gate electrodes 40 direct the electrons emitted by the emitters toward the phosphor layer of the anode structure.

As shown in FIG. 7, the anode structure and the cathode structure are brought together so that the glass spacer spheres 30 contact and rest on the gate electrodes 40 and provide separation between the transparent anode substrate 20 and the cathode substrate 50. The region 65 between the transparent anode substrate 20 and the cathode substrate 50 will be evacuated and the solid glass rod 28 bonded to the glass spacer sphere 30 contacting the gate electrode is required to maintain uniform separation between the anode substrate 20 and the cathode substrate 50 as well as flatness of the anode substrate 20 and cathode substrate 50.

Electrons emitted by the emitters 42 impinge on the phosphor layer 24 forming an image visible to the viewer observing the second surface of the anode substrate 67. The solid glass rod 28 bonded to the glass spacer sphere 30 and the transparent conductor layer 22 disrupts the continuity of the phosphor layer 24 which will cause dark areas in the image. The aspect ratio, the ratio of height to cross sectional area, of the solid glass rod 28 and the glass spacer sphere 30 of this embodiment is greater than two. The dark area in the image due to the solid glass rod 28 and the glass spacer sphere 30 of this embodiment will have a diameter of less than 50 micrometers at each location. This dark area of less than 50 micrometers diameter will not be visible to the human eye and will be invisible to an observer of the image. The quality of the image will not be affected by the spacers.

While the invention has been particularly shown and described with reference to the preferred embodiments thereof, it will be understood by those skilled in the art that various changes in form and details may be made without departing from the spirit and scope of the invention.

What is claimed is:

1. A method of forming spacers for a field emission display, comprising the steps of:

providing a cathode structure for a field emission display;

providing a transparent substrate having a first surface;

providing a transparent conductor layer formed on said first surface of said transparent substrate;

forming a phosphor layer on said transparent conductor layer;

forming a layer of photoresist on said phosphor layer;

forming a number of regularly spaced cylindrical photoresist holes in said layer of photoresist;

forming a number of regularly spaced cylindrical phosphor holes in said phosphor layer equal to the number of photoresist holes wherein each said phosphor hole is directly below one of said photoresist holes;

filling each said photoresist hole and each said phosphor hole with an adhesive dielectric paste thereby forming a column of adhesive dielectric paste in each said photoresist hole and each said phosphor hole;

placing a spacer sphere over each said column of adhesive dielectric paste;

firing said spacer spheres, said columns of adhesive dielectric paste, and said photoresist layer thereby coalescing each said column of adhesive dielectric paste into a solid dielectric post, forming a bond between each said solid dielectric post and said spacer sphere over said column of adhesive dielectric paste which forms said solid dielectric post, forming a bond between each said solid dielectric post and said transparent conducting layer, and burning off said photoresist layer; and bringing together said cathode structure and said first surface of said transparent substrate wherein each said solid dielectric post and each said spacer sphere bonded to said solid dielectric post provide separation between said first surface of said transparent substrate and said cathode structure.

2. The method of claim 1 wherein said transparent substrate is glass having a thickness of between about 0.55 and 3.0 millimeters.

3. The method of claim 1 wherein said transparent conductor layer is indium tin oxide having a thickness of between about 20 and 300 nanometers.

4. The method of claim 1 wherein said layer of photoresist is a dry resist film having a thickness of between about 25 and 100 micrometers.

5. The method of claim 1 wherein said adhesive dielectric paste comprises glass frit in a binder.

6. The method of claim 1 wherein said spacer spheres are glass spheres having a diameter of between about 50 and 200 micrometers.

7. The method of claim 1 wherein said firing of said spacer spheres, said columns of adhesive dielectric paste, and said photoresist layer occurs at a temperature of between about 450° C. and 520° C. for about 10 to 45 minutes.

8. The method of claim 1 wherein said solid dielectric post is glass.

9. The method of claim 1 wherein said solid dielectric post has a diameter of between about 25 and 50 micrometers and a height between about 25 and 100 micrometers.

10. The method of claim 1 wherein said phosphor layer comprises red phosphor regions, green phosphor regions, and blue phosphor regions.

* * * * *